US010337695B2

(12) United States Patent
Madril et al.

(10) Patent No.: US 10,337,695 B2
(45) Date of Patent: Jul. 2, 2019

(54) REFLECTOR FOR LIGHTING COMPONENT WITH SURFACES THAT SUBTEND LIGHT FROM A LIGHT SOURCE AND SURFACES THAT SUBTEND EXTERNAL LIGHT

(71) Applicant: JST Performance, LLC, Gilbert, AZ (US)

(72) Inventors: Edgar A. Madril, Mesa, AZ (US); Ronald G. Holder, Laguna Niguel, CA (US)

(73) Assignee: JST Performance, LLC, Gilbert, AZ (US)

( * ) Notice: Subject to any disclaimer, the term of this patent is extended or adjusted under 35 U.S.C. 154(b) by 45 days.

(21) Appl. No.: 15/334,856

(22) Filed: Oct. 26, 2016

(65) Prior Publication Data

US 2018/0112849 A1 Apr. 26, 2018

(51) Int. Cl.

| | |
|---|---|
| ***F21V 7/06*** | (2006.01) |
| ***F21V 23/00*** | (2015.01) |
| ***F21V 7/00*** | (2006.01) |
| ***F21K 9/68*** | (2016.01) |
| ***F21L 4/02*** | (2006.01) |
| *F21Y 115/10* | (2016.01) |
| *F21Y 105/10* | (2016.01) |

(52) U.S. Cl.

CPC ..... *F21V 7/06* (2013.01); *F21K 9/68* (2016.08); *F21L 4/027* (2013.01); *F21V 7/0083* (2013.01); *F21V 23/005* (2013.01); *F21Y 2105/10* (2016.08); *F21Y 2115/10* (2016.08)

(58) Field of Classification Search

CPC .. F21V 7/06; F21V 7/09; F21V 7/0025; F21S 48/1317; F21S 48/1323; F21S 48/1335; F21S 48/1341; F21S 48/1347; F21S 48/1352; F21S 48/1358; F21S 48/1364; F21S 48/137; F21S 48/1376; F21S 48/1382; F21S 48/1388; F21S 41/332; F21S 41/333

USPC ..... 362/297, 302, 304, 346, 348, 350, 362/516–518

See application file for complete search history.

(56) References Cited

U.S. PATENT DOCUMENTS 7,207,697 B2 * 4/2007 Shoji ..... F21V 5/045 362/187

2007/0247856 A1 * 10/2007 Wang ..... F21V 7/005 362/297

(Continued)

*Primary Examiner* — Anh Mai
*Assistant Examiner* — Michael Chiang

(57) ABSTRACT

A lighting component may include a light emitting diode (LED) positioned on a printed circuit board assembly (PCBA), and a reflector positioned on the PCBA over the LED. The LED may be configured to emit an effective span of light which may pass through the reflector from a rearward opening to a forward opening of the reflector. The reflector may include a first region with one or more surfaces configured to subtend a first portion of the effective span of light. The reflector may include a second region with one or more first surfaces configured to subtend a second portion of the effective span and one or more second surfaces configured to subtend exterior light entering the forward opening back through the forward opening. The reflector may include a third region with one or more surfaces configured to subtend exterior light entering the forward opening back through the forward opening.

20 Claims, 6 Drawing Sheets

(56) References Cited

U.S. PATENT DOCUMENTS

| | | | | |
|---|---|---|---|---|
| 2010/0195333 | A1* | 8/2010 | Schaefer | F21V 7/0083 362/294 |
| 2015/0036354 | A1* | 2/2015 | Adams | F21V 5/007 362/311.02 |
| 2015/0285442 | A1* | 10/2015 | Smith | F21V 13/04 362/309 |
| 2016/0273734 | A1* | 9/2016 | Gassner | G02B 19/0066 |
| 2017/0130921 | A1* | 5/2017 | Komano | F21S 48/1159 |

* cited by examiner

REFLECTOR FOR LIGHTING COMPONENT WITH SURFACES THAT SUBTEND LIGHT FROM A LIGHT SOURCE AND SURFACES THAT SUBTEND EXTERNAL LIGHT

FIELD OF THE INVENTION

The present invention generally relates to lighting systems, and more particularly to a system for distributing light in a specified range.

BACKGROUND

Light emitting diodes (LEDs) have been utilized since about the 1960s. However, for the first few decades of use, the relatively low light output and narrow range of colored illumination limited the LED utilization role to specialized applications (e.g., indicator lamps). As light output improved, LED utilization within other lighting systems, such as within LED "EXIT" signs and LED traffic signals, began to increase. Over the last several years, the white light output capacity of LEDs has more than tripled, thereby allowing the LED to become the lighting solution of choice for a wide range of lighting solutions.

LED lighting solutions have introduced other advantages, such as increased reliability, design flexibility, and safety. For example, traditional turn, tail, and stop signal lighting concepts have been integrated into full combination lamps. Lighting solutions may be designed to optimize light distribution for a number of applications, such as in fair or adverse weather conditions (e.g., dust, fog, rain, and/or snow). For example, a lighting solution may emit light in short or long range, produce a wide or a narrow beam pattern, and/or produce a short or a tall beam pattern.

LED lighting solutions may include LEDs, a printed circuit board (PCB), and associated control circuitry. Various elements of each lighting solution may be selected to optimize travel of light away from the LED (e.g., to produce a particular beam pattern).

Due to the vast amount of variability in selecting elements of a lighting solution, efforts continue to develop particular directional and patterned beams which cater to the specific application for which it was intended.

SUMMARY

An embodiment is proposed for a reflector, the reflector comprising a rearward opening diametrically opposed to a forward opening; a first region including one or more first surfaces configured to subtend light passing through the reflector from the rearward opening to the forward opening; and a second region coupled to the first region, the second region including, one or more second surfaces configured to subtend light passing through the reflector from the rearward opening to the forward opening; and one or more third surfaces configured to subtend exterior light entering the forward opening.

Another embodiment is proposed for a lighting component, the lighting component comprising a PCBA; an LED coupled to the PCBA, the LED configured to emit an effective span of light; and a reflector coupled to the PCBA in proximity to the LED so that the effective span of light passes through the reflector from a rearward opening of the reflector to a forward opening of the reflector, the reflector including: a first region including one or more first surfaces configured to subtend a first portion of the effective span of light; and a second region coupled to the first region, the second region including, one or more second surfaces configured to subtend a second portion of the effective span of light; and one or more third surfaces configured to subtend exterior light entering the forward opening.

Another embodiment is proposed for a light fixture, the light fixture comprising a housing; a PCBA coupled to the housing; an LED coupled to the PCBA, the LED configured to emit an effective span of light; a media extending over the housing to enclose the PCBA and LED; and a reflector coupled to the PCBA in proximity to the LED so that the effective span of light passes through the reflector from a rearward opening of the reflector to a forward opening of the reflector, the reflector including, a first region including one or more first surfaces configured to subtend a first portion of the effective span of light; and a second region coupled to the first region, the second region including, one or more second surfaces configured to subtend a second portion of the effective span of light; and one or more third surfaces configured to subtend exterior light entering the forward opening.

BRIEF DESCRIPTION OF THE DRAWINGS

Various aspects and advantages of the invention will become apparent upon review of the following detailed description and upon reference to the drawings in which.

DETAILED DESCRIPTION

Figure 1A:
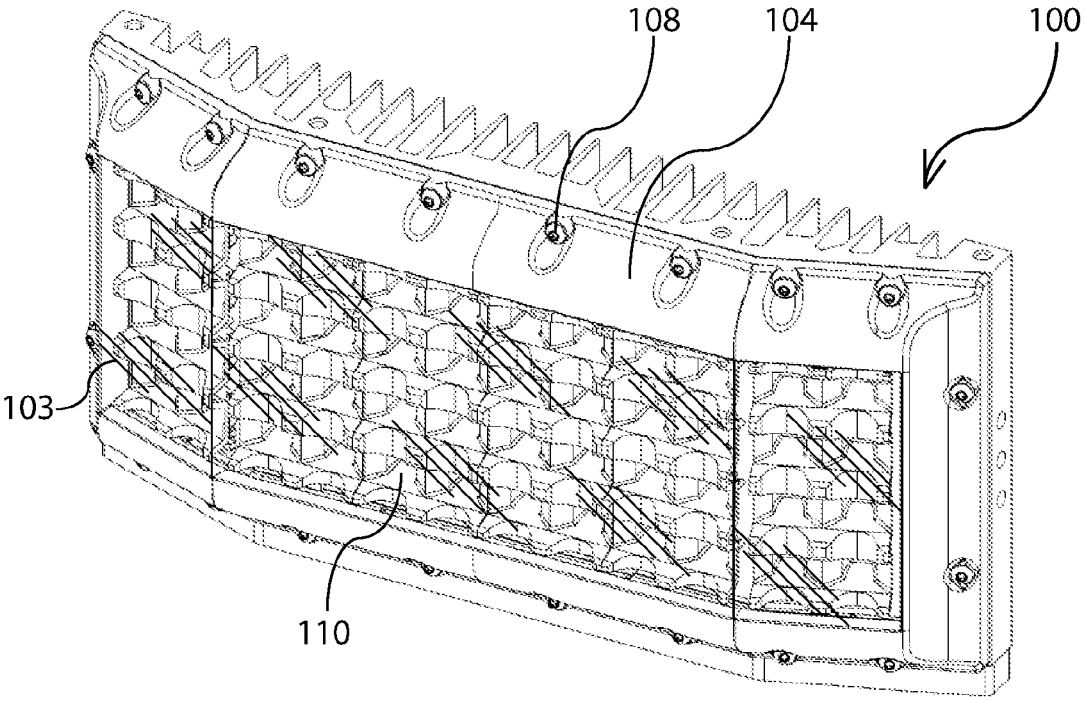
FIG. 1A illustrates an isometric view of a light fixture incorporating one or more lighting components according to an embodiment of the present invention.

Generally, the various embodiments of the present invention are applied to an apparatus for or a method of distributing light. Specifically, the present invention may include a lighting component which subtends light within a specified range and/or into a desired target luminance. Subtend, subtends, subtending, subtended, and any other form or derivative of subtend may refer to the manipulation, modification, conversion, and/or filtering of light as it pertains to direction, wavelength, amplitude, or any other known characteristic of light. For example, the direction of light may be modified by being collimated, focused, diffused, and/or shifted. Collimated light may refer to a span of light where each light ray has been modified to travel in a direction substantially parallel to every other light ray in the span. Focused light may refer to a span of light which has been narrowed or widened as compared to the dimensional span of the light prior to modification. Diffused light may refer to a span of light where each light ray has been modified to travel in diverse and/or random directions with respect to every other light ray in the span. Shifted light may refer to a span of light which has an identical dimensional span as the light prior to modification, but which travels in a different direction.

The lighting component may include a printed circuit board assembly (PCBA), a light emitting diode (LED) configured on the PCBA to emit light, and a reflector configured on the PCBA to receive an effective span of the light emitted by the LED. For example, the effective span may refer to some portion of the light emitted by the LED that is less than all of the light. In another example, the effective span may refer to some percentage of all the light emitted by the LED (e.g., 90%). In another example, the effective span may refer to that portion of the light with a luminous intensity above a desired value. In another example, the effective span may refer to that portion of light falling within a specified span.

The reflector may be configured to subtend a portion of the light emitted by the LED. Further a portion of the light emitted by the LED may pass through the reflector from a rearward portion to a forward portion without being subtended. The precise dimensions of the non-subtended portion may be determined by the configuration of the reflector. In addition, the reflector may be configured to subtend exterior light emanating from a source exterior of the lighting component and passing through the forward portion so that it passes back through the forward portion.

The subtending of light may be accomplished by configuring the reflector with one or more reflective surfaces, where each surface is configured to either subtend light emitted by the LED, restrict the span of non-subtended light, and/or subtend light emitted by a light source outside the lighting component. For example, the dimensions, foci, and/or spacing of each surface may be modified to optimize the passage of subtended and/or non-subtended light. A first region may be configured to entirely subtend light emitted by the LED and/or restrict the span of non-subtended light. A second region may be configured to subtend light emitted by the LED, restrict the span of non-subtended light, and/or subtend light emitted by a light source outside the lighting component. A third region may be configured to subtend light emitted by a light source outside the lighting component only.

The first, second, and third regions may be arranged in a particular order to optimize luminous intensity. For example, first, second, and third regions, and their respective reflective surfaces, may cause light emitted by the LED to pass into a target luminance (e.g., a beam pattern). Each set of first, second, and third regions of the reflector, together with the LED and PCBA may form a quadrant, which may be repeatable in a series or array of quadrants to optimize the target luminance.

Thus, a lighting component may take on any incremental size and may embody any number of quadrants, each quadrant including a dedicated LED to optimize the target luminance (e.g., 1×1, 1×2, 2×1, 2×2, or larger). Furthermore, one or more lighting components may be arranged in a series or array within a light fixture to further optimize the target luminance.

The one or more lighting components may be enclosed and/or sealed within the light fixture by a media (e.g., a transparent media) to prohibit entry of moisture or other contaminants. The one or more lighting components may be secured by compression between the media and the light fixture. Further, the reflectors of each lighting component may include one or more crowns to enable securement by compression between the media and the PCBA. A bezel may be interconnected with the light fixture to cause the media to be compressed against the reflectors.

Figure 1B:
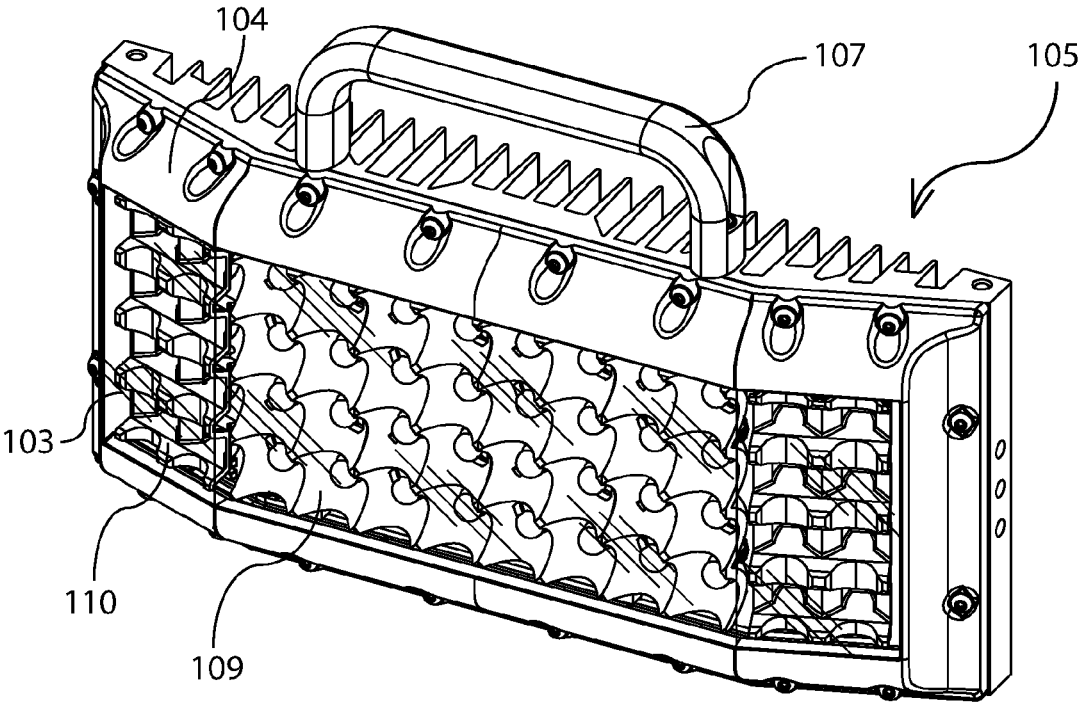
FIG. 1B illustrates an isometric view of another embodiment of a light fixture incorporating one or more lighting components according to another embodiment of the present invention.

FIGS. 1A and 1B illustrate examples of light fixtures incorporating one or more lighting components. For example, in FIG. 1A, light fixture 100 may incorporate one or more lighting components 110 of the present invention. In another example, in FIG. 1B, light fixture 105 may incorporate one or more lighting components 110 of the present invention in combination with one or more other lighting components 109.

Each light fixture 100, 105 may have a cavity (not shown) therein for receiving the one or more lighting components 110. A transparent media 103 may extend over the cavity, may enclose the cavity, and/or may seal the cavity. A bezel 104 may extend around at least a portion of transparent media 103, and may enable securement of transparent media 103 to each light fixture 100, 105. For example, bezel 104 may be secured by one or more fasteners 108. Furthermore, one or more gaskets (not shown) may be configured to seal transparent media 103 to bezel 104 and/or to seal media 103 to each light fixture 100, 105. Thus, respective cavities of each light fixture 100, 105 may be sealed to prevent passage of air, water, and/or other particulates.

The cavity of each light fixture 100, 105 may be configured to enable one or more of lighting components 109, 110 to be mounted on non-parallel surfaces (e.g., as exemplified in FIGS. 1A, 1B). For example, each light fixture may include two or more non-parallel surfaces (e.g., three non-parallel surfaces). The non-parallel surfaces may enable light emitted collectively by the one or more lighting components 109, 110 to be emitted in a wider span of emission than for a single surface and/or a plurality of parallel surfaces.

Each non-parallel surface may be capable of receiving the same and/or a different number of lighting components 109, 110. For example, a first non-parallel surface may be configured with four lighting components 110 (e.g., lighting component 510E of FIG. 5E). In another example, the first non-parallel surface may be configured with eight lighting components 109. In another example, a second non-parallel surface inclined with respect to the first non-parallel surface may be configured with one lighting component 110. In another example, a third non-parallel surface inclined with respect to the first non-parallel surface and positioned oppositely the second non-parallel surface may be configured with one lighting component 110.

Power may be provided to the one or more lighting components 109, 110 (e.g., via a cable, not shown) to enable the emission of light during operation of each light fixture 100, 105. Each lighting component 109, 110 may include one or more PCBAs (e.g., PCBA 220 of FIG. 2), a reflector (e.g., reflector 240 of FIG. 2) having one or more quadrants (e.g., quadrants 511A, 512A of FIG. 5A), and one or more LEDs (e.g., LED 230 of FIG. 2) associated with each quadrant. Additionally, more than one reflector may share a single PCBA. For example, each non-parallel surface may be configured to receive a single PCBA, and each PCBA may be configured to receive one or more reflectors.

Each PCBA may include control circuitry that may be capable of regulating power to the one or more LEDs (e.g., capable of operating in one or more operational modes). For example, the PCBA may be capable of on, off, high, low and intermittent power modes (e.g., strobing). In another example, each lighting component 110, each reflector, and/or each quadrant may be operated in on, off, high, low, and/or intermittent power modes. A person of ordinary skill in the art will appreciate that other modes of operation are possible.

Each lighting component 110 may have one or more quadrants of repeating configuration (e.g., the configuration described with respect to FIGS. 2-4B). Furthermore, quadrants may appear in a series or array (e.g., as described with respect to FIGS. 5A-5D). Furthermore, each lighting component 110 may be placed in a side-by-side and/or end-to-end configuration with adjoining lighting components 110. For example, each lighting component 110 may be linearly and/or rotationally offset from at least one other lighting component 110 on corresponding and/or non-corresponding non-parallel surfaces. As exemplified in FIG. 1A, a series of lighting components 110 (e.g., four lighting components 110) positioned centrally in light fixture 100 may form an array of quadrants having eight columns and four rows.

The one or more LEDs corresponding to each quadrant may emit light having any wavelength in the visible spectrum (e.g., 390 nm to 700 nm) to optimize visibility from light emitted by the light fixture. For example, the one or more LEDs corresponding to each quadrant may emit light having all wavelengths in the visible spectrum (e.g., white light). In another example, the one or more LEDs corresponding to each quadrant may emit light in a non-visible spectrum (e.g., infrared and/or ultraviolet light). In another example, each quadrant, each reflector, each lighting component, and/or the lighting components of each non-parallel surface may emit light having one or more of the above wavelengths of light. A person of ordinary skill in the art will appreciate that various wavelengths of visible and non-visible light emission is possible.

As exemplified in FIG. 1B, light fixture 105 may be configured with a handle 107 to enable a user to adjust an orientation of light fixture 105 during operation, to protect the user from exposure to heat produced by light fixture 105 during operation, and/or for ease of use while being carried.

Figure 2:
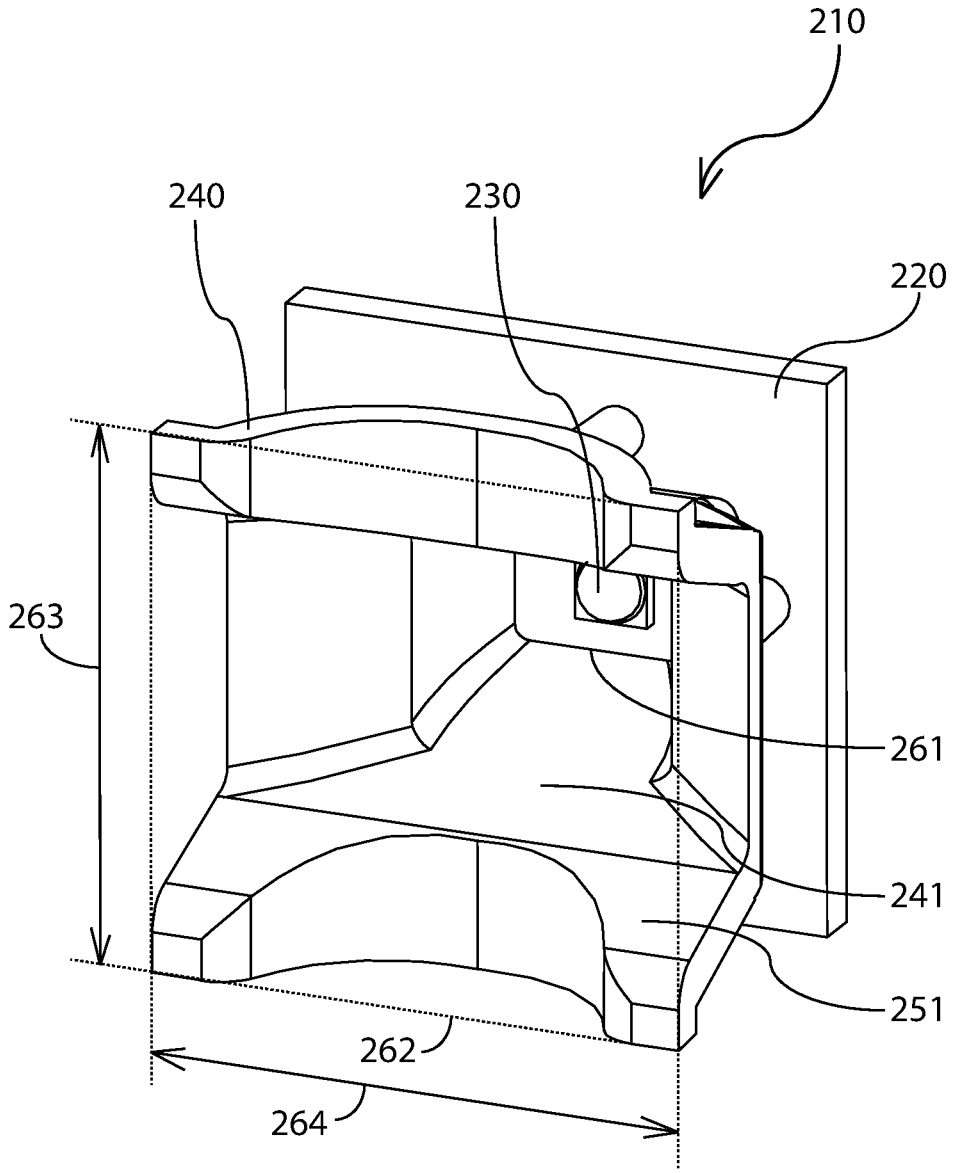
FIG. 2 illustrates an isometric view of a lighting component according to another embodiment of the present invention.

FIG. 2 illustrates a lighting component 210 including a PCBA 220, an LED 230 configured on PCBA 220, and a reflector 240 configured on PCBA 220. PCBA 220 may include control circuitry for regulating power provided to LED 230. For example, when electrical power is provided to LED 230, LED 230 may convert electrical power into visible and/or non-visible light having a particular wavelength. In another example, LED 230 may be configured to convert electrical power into any wavelength in a range of wavelengths based on power provided by the control circuitry of PCBA 220. In another example, LED 230 may be a red-green-blue (RGB) LED.

Reflector 240 may be optimally configured to subtend at least a portion of the light emitted by LED 230 (e.g., to collimate, focus, diffuse, and/or shift light). For example, reflector 240 may be configured so that an effective span of emission (e.g., span 331 of FIG. 3B) passes through reflector 240 from a rearward opening 261 to a forward opening 262 thereof. In another example, reflective surfaces 241 may subtend a portion of the light emitted by LED 230 (e.g., a portion of the effective span). In another example, reflector 240 may be optimally spaced from PCBA 220 and/or LED 230 (e.g., as discussed with reference to legs 365 of FIG. 3). In another example, reflector 240 may be optimally configured with respect to PCBA 220 (e.g., as discussed with reference to pins 366 of FIG. 3).

Further, reflector 240 may be configured to subtend light emanating from outside of lighting component 210. For example, reflective surfaces 251 may subtend light emitted from outside the system (e.g., from a light source exterior to a light fixture incorporating lighting component 210). In another example, reflective surfaces 251 may not subtend any light emitted by LED 230.

PCBA 220 may be any suitable size and/or shape to accommodate reflector 240 and/or to enable PCBA 220 to be configured within a light fixture (e.g., light fixture 105 of FIG. 1). For example, while PCBA 220 is exemplified as substantially square, a person of ordinary skill in the art will appreciate that other shapes (e.g., rectangular) may be employed to enable PCBA 220 to be arranged in a series and/or array of lighting components 110 (e.g., as exemplified in FIGS. 1A-1B). In another example, a height and width of PCBA 220 may correspond to a height and width of reflector 240. In another example, the heights and widths of PCBA 220 and reflector 240 may correspond to a height 263 and width 264 of lighting component 210.

Height 263 may be larger, equal to, or smaller in dimension that width 264. For example, the ratio of height 263 to width 264 may be between about 1:5 and 5:1 (e.g., about 1:1). In another example, height 263 and width 264 may be between about 0.25 inches and about 5 inches (e.g., about 1 inch). The dimensions of height 263 and width 264 may be sized to enable reflector 220 to have a specified number of quadrants of repeating design (e.g., quadrants 511A, 512A of FIG. 5A). For example, reflector 240 is exemplified with a single quadrant.

Where a light fixture includes more than one PCBA 220, each PCBA 220 may be mechanically and/or electrically interconnected to enable accurate positioning and/or control of each lighting component 210.

Figure 3B:
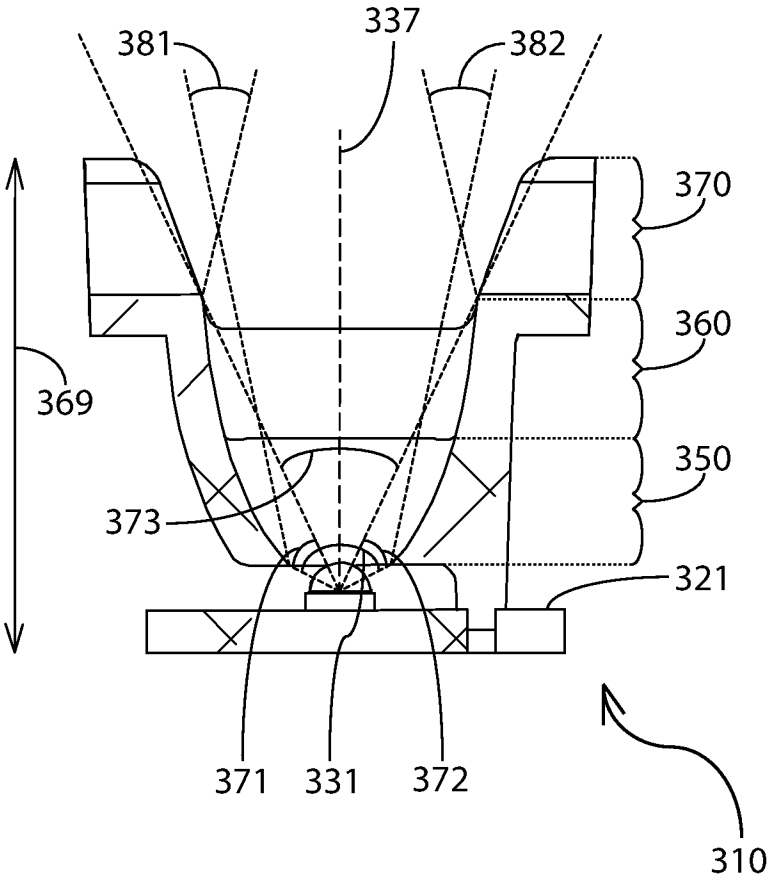
FIG. 3B illustrates a photometric diagram of a cross-sectional view of the lighting component of FIG. 2.
Figure 3A:
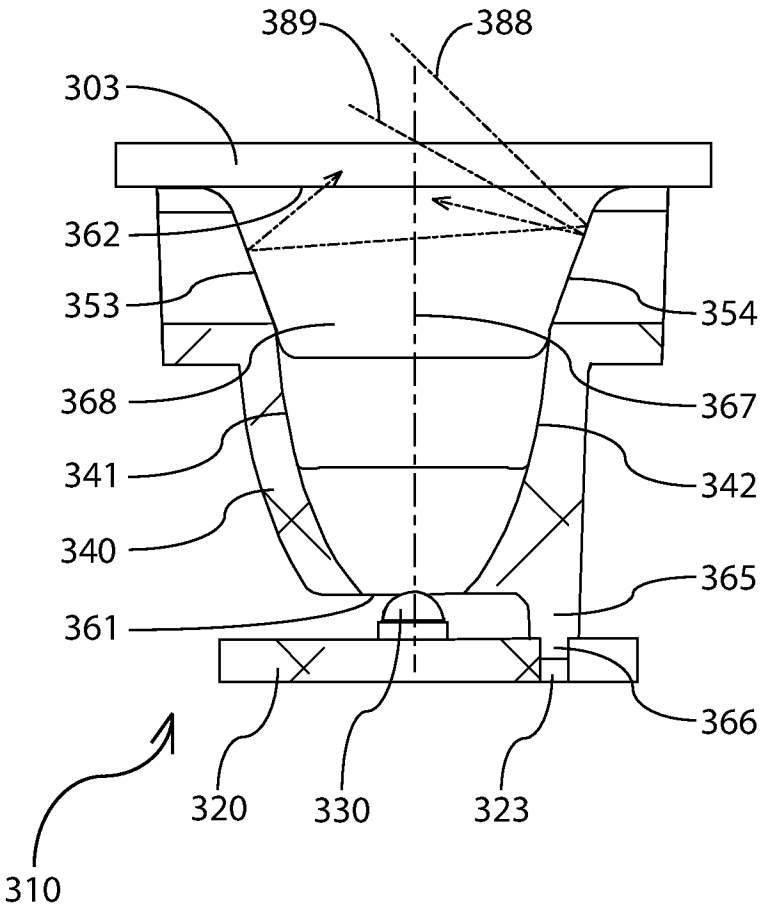
FIG. 3A illustrates a photometric diagram of a cross-sectional view of the lighting component of FIG. 2.

FIGS. 3A and 3B each illustrate a cross-sectional view of a lighting component 310 including a PCBA 320, an LED 330 configured on PCBA 320, and a reflector 340 configured on PCBA 320. For example, the cross-section may extend along a height of (e.g., height 263 of FIG. 2), and at a width of (e.g., width 264 of FIG. 2), the lighting component 310. Furthermore, lighting component 310 may be capable of receiving a transparent media 303 (as exemplified in FIG. 3A) disposed oppositely of PCBA 320. Alternatively, transparent media 303 may be translucent, opaque, and/or may have regions of transparency, translucence, or opaqueness to enable greater control (e.g., subtending) of light as it passes therethrough.

Reflector 340 may be spaced an optimal separation distance from LED 330 and/or PCBA 320 so that heat generated by LED 330 may not cause deformation and/or melting of reflector 340. For example, rearward opening 361 may be spaced the optimal separation distance from LED 330 so that no portion of reflector 340 is close enough to be deformed and/or melted by LED 330 during operation. In another example, reflector 340 may be spaced the optimal separation distance from PCBA 320 by one or more extension portions (e.g., legs 365).

Reflector 340 may be secured to PCBA 320 in an optimal geometric configuration so that light emitted by LED 330 may be subtended into one or more subtended spans (e.g., span 381 of FIG. 3B). For example, one or more mechanical indexing features (e.g., pins 366) may extend from reflector 340 and may be capable of interconnecting with one or more mechanical indexing features (e.g., slots 323) of PCBA 320. In another example, pins 366 may extend from legs 365 into slots 323 (as exemplified in FIG. 3A).

Reflector 340 may be formed of one or more regions (e.g., first region 350). For example, reflector 340 may include any one or more of a first region 350, a second region 360, and/or a third region 370. Each of the one or more regions may be formed by one or more reflective surfaces (e.g., LED surfaces) which may subtend light emitted by LED 330, reflective surfaces (e.g., non-LED surfaces) which may subtend light originating from outside lighting component 310, and/or both. Each region of reflector 340 may have unique and/or common reflective surfaces configured about a central axis 367 extending through a central cavity 368 of reflector 340.

For example, first region 350 may include a bottom LED surface 341 and a top LED surface 342 configured oppositely of central axis 367. In another example, bottom and top LED surfaces 341, 342 may extend into second region 360 (e.g., bottom and top LED surfaces 341, 342 may extend through both the first and second regions). Bottom and top LED surfaces 341, 342 may be flat and/or curved (e.g., parabolic) to subtend emitted light into one or more subtended spans (e.g., span 382 of FIG. 3B). Thus, as exemplified in FIGS. 3A and 3B, bottom and top LED surfaces 341, 342 may form a parabolic trough extending through the first and second regions 350, 360 (e.g., extending a width-wise dimension corresponding to width 264 of FIG. 2).

Further, bottom and top LED surfaces 341, 342 may be mirror images of each other or not, may have unique or similar foci, and/or may be equally spaced from central axis 367 or not, to optimize the subtended spans produced thereby (e.g., as exemplified by subtended spans 381, 382 of FIG. 3B). For example, where bottom and top LED surfaces 341, 342 have common or identical foci and are spaced equally from central axis 367, subtended light may be produced with spans having a particular dimension (e.g., symmetric across central axis 367). In another example, a change in foci of one or both of bottom and top LED surfaces 341, 342 may widen or narrow the span of subtended light. In another example, altering the spacing from central axis 367 may cause the subtended light to shift, widen, or narrow.

In another example, third region 370 may include a bottom non-LED surface 353 and a top non-LED surface 354 positioned oppositely of central axis 367. Bottom and top non-LED surfaces 353, 354 may be flat and/or curved to subtend (e.g., reflect) light from outside a light fixture containing lighting component 310 (e.g., light fixture 100 of FIG. 1A). Further, bottom and top non-LED surfaces 353, 354 may be mirror images of each other or not, and/or may be equally spaced from central axis 367 or not, to optimize the way light originating from outside the system is subtended (e.g., as exemplified by light rays 388, 389 of FIG. 3A).

First, second and third regions 350, 360, 370 may be stacked with each region appearing in a particular order to optimize subtended and non-subtended light from LED 330, and/or to optimize subtended light emanating from outside lighting component 310. For example, as exemplified in FIG. 3B, first region 350 may extend from PCBA 320. In another example, second region 360 may extend from first region 350 oppositely of PCBA 320. In another example, third region 370 may extend from second region 360 oppositely of first region 350.

When LED 330 is supplied with electrical power, electrical power may be converted by LED 330 into visible and/or non-visible light. The light may be emitted from LED 330 and may pass through reflector 340. For example, all or substantially all the light emitted by LED 330 may be passed through central cavity 368. In another example, an effective span 331 of light emitted by LED 330 may pass entirely into central cavity 368. Effective span 331 may include an axis of symmetry 337 which may extend perpendicularly to a surface 321 of PCBA 320, may extend collinearly or parallel to central axis 367, and/or may extend at an incline with respect to central axis 367. In another example, light emitted by LED 330 may pass through central cavity 368, transparent media 303, or both.

Discrete portions of effective span 331 may be subtended (e.g., by bottom and top LED surfaces 341, 342) and/or discrete portions of effective span 331 may pass through reflector 340 without being subtended by reflector 340. For example, a bottom portion 371 of effective span 331 may be subtended (e.g., reflected) by bottom LED surface 341 to produce bottom subtended span 381. In another example, a top portion 372 of effective span 331 may be subtended (e.g., reflected) by top LED surface 342 to produce top subtended span 382. In another example, a third portion 373 of effective span 331 may pass through reflector 340 without being subtended by bottom and top LED surfaces 341, 342.

Bottom and top subtended spans 381, 382 may be any one or more of collimated, focused, diffused, and/or shifted light. For example, bottom and top subtended spans 381, 382 may be substantially equal in dimension to bottom and top portions 371, 372, but passing in a different direction (e.g., shifted). In another example, bottom and top subtended spans 381, 382 may be wider or narrower in dimension than bottom and top portions 371, 372 (e.g., focussed). In another example, bottom and top subtended spans 381, 382 may include light passing in a uniform direction (e.g., collimated). In another example, bottom and top subtended spans 381, 382 may include light passing in diverse and random directions (e.g., diffused). In another example, bottom and top subtended spans 381, 382 may pass entirely within a span of third portion 373. In another example, bottom and top subtended spans 381, 382 may be symmetric or non-symmetric about central axis 367. In another example, third portion 373 may not be any of collimated, focused, diffused, and/or shifted light.

The span of third portion 373 may be at least in part determined by a dimension of first and second regions 350, 360 in a depth-wise direction 369 and/or by the spacing between central axis 367 and opposing bottom and top LED surfaces 341, 342, or any combination thereof. Thus, the dimensions of first and second regions 350, 360 in depth-wise direction 369 and/or the spacing between central axis 367 and one or more of bottom and top LED surfaces 341, 342 may be altered in order to optimize the span of third portion 373. For example, third portion 373 may have a span of between about 5 degrees and about 120 degrees (e.g., about 40 degrees). In another example, third portion 373 may be emitted symmetrically and/or non-symmetrically on either side of axis of symmetry 337.

One or more light rays originating from outside lighting component 310 (e.g., light rays 388, 389) may contact one or more of bottom and top non-LED surfaces 353, 354, or other surfaces of the system (e.g., non-LED surface 455 of FIG. 4), and may be reflected away from reflector 340. Thus, reflector 340 may have a reflective quality whether or not LED 330 receives electrical power.

Figure 4B:
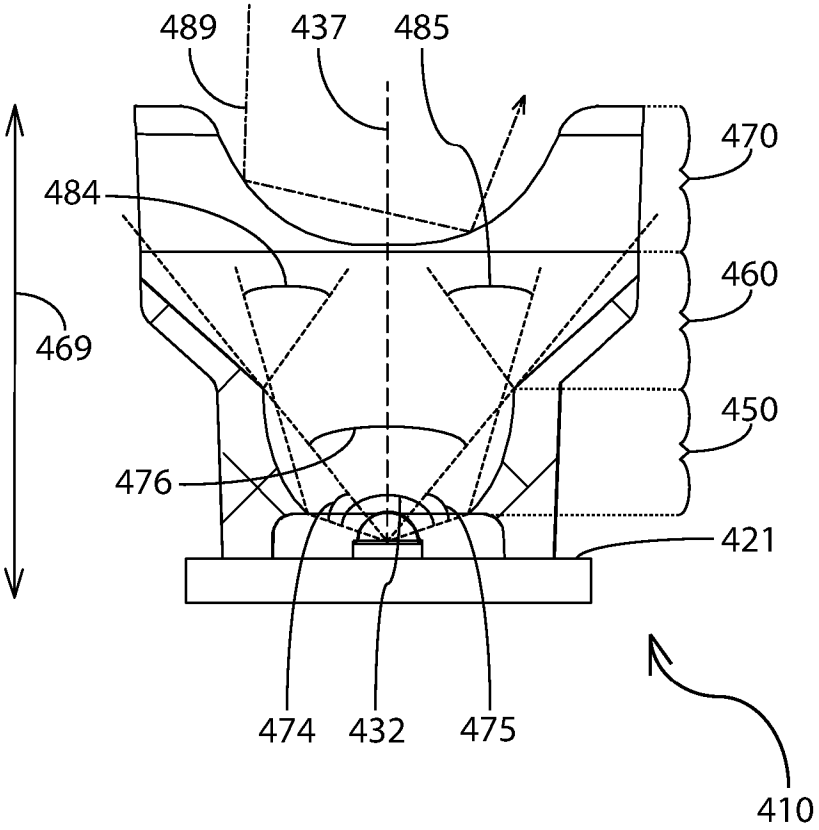
FIG. 4B illustrates a photometric diagram of a cross-sectional view of the lighting component of FIG. 2.
Figure 4A:
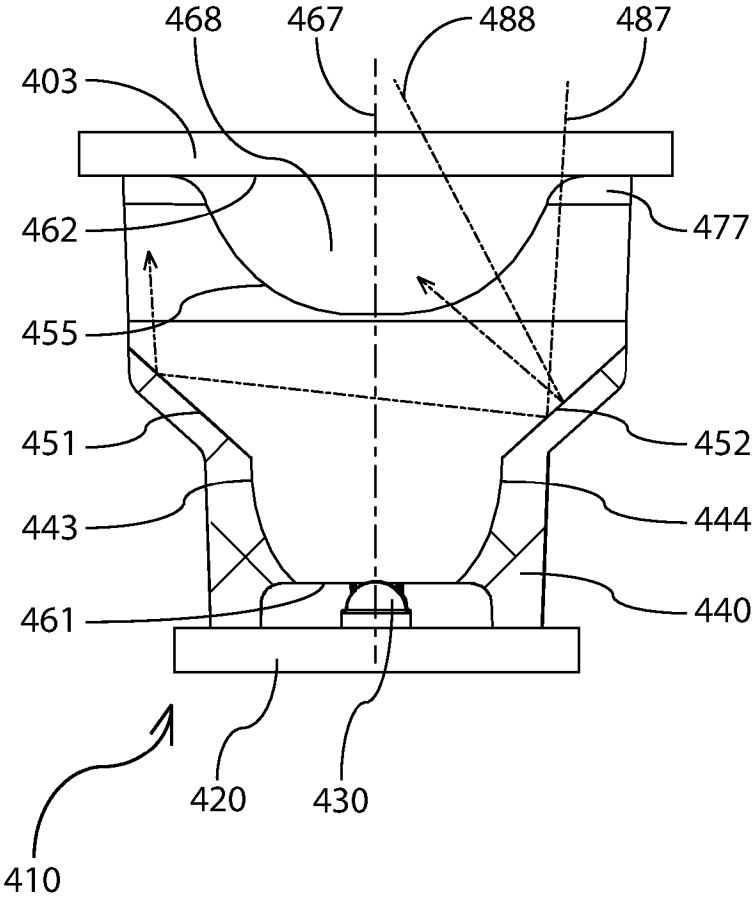
FIG. 4A illustrates a photometric diagram of a cross-sectional view of the lighting component of FIG. 2.

FIGS. 4A and 4B each illustrate a cross-sectional view of a lighting component 410 including a PCBA 420, an LED 430 configured on PCBA 420, and a reflector 440 configured on PCBA 420. For example, the cross-section may extend along a width of (e.g., width 264 of FIG. 2), and at a height of (e.g., height 263 of FIG. 2), the lighting component 410. Furthermore, lighting component 410 may be capable of receiving a transparent media 403 (as exemplified in FIG. 4A) disposed oppositely of PCBA 420.

Reflector 440 may be formed of one or more regions (e.g., first region 450). For example, reflector 440 may include any one or more of a first region 450, a second region 460, and/or a third region 470. Each of the one or more regions may be formed by one or more reflective surfaces (e.g., LED surfaces) which may subtend light emitted by LED 330, reflective surfaces (e.g., non-LED surfaces) which may subtend light originating from outside lighting component 310, and/or both. Each region of reflector 440 may have unique and/or common reflective surfaces configured about a central axis 467 extending through a central cavity 468 of reflector 440.

For example, first region 450 may include a left LED surface 443 and a right LED surface 444 positioned oppositely of central axis 467. Left and right LED surfaces 443, 444 may be flat and/or curved (e.g., parabolic) to subtend emitted light into one or more subtended spans (e.g., span 484 of FIG. 4B). Further, left and right LED surfaces 443, 444 may be mirror images of each other or not, may have unique or similar foci, and/or may be equally spaced from central axis 467 or not, to optimize the subtended spans produced thereby (e.g., as exemplified by subtended spans 484, 485 of FIG. 4B). Thus, as exemplified in FIGS. 4A and 4B, left and right LED surfaces 443, 444 may form a parabolic trough extending through the first region 350 (e.g., extending a height-wise dimension corresponding to height 263 of FIG. 2).

In another example, second region 360 may include a left non-LED surface 451 and a right non-LED surface 452 positioned oppositely of central axis 467. Left and right non-LED surfaces 451, 452 may be flat and/or curved to subtend (e.g., reflect) light emanating from outside lighting component 410. Left and right non-LED surfaces 451, 452 may be mirror images of each other or not, and/or may be equally spaced from central axis 367 or not, to optimize the way light originating from outside lighting component 410 is subtended (e.g., as exemplified by light rays 487, 488 of FIG. 4A). Further, left and right non-LED surfaces 451, 452 may be configured so that no light emitted by LED 430 is subtended by left and right non-LED surfaces 451, 452 (e.g., as exemplified in FIG. 4B).

In another example, third region 470 may include one or more crowns 477 (e.g., four crowns, one at each corner of reflector 440) to enable securement of reflector 440 between PCBA 420 and transparent media 403 and/or stable contact of reflector 440 against transparent media 403. While reflector 440 is exemplified with at least two crowns, a person of ordinary skill in the art will appreciate that reflector 440 may be configured with greater or fewer crowns (e.g., 1, 2, 3, 4, 5, 6, or more crowns). In general, the one or more crowns 477 may be any shape or texture, and may be designed to satisfy any aesthetic purpose. For example, third region 470 may include a non-LED surface 455 extending on either side of central axis 467. Non-LED surface 455 may be flat and/or curved to subtend (e.g., reflect) external light (e.g., light emanating from outside the lighting component 410), which may optimize the way external light is subtended (e.g., as exemplified by light ray 489 of FIG. 4B). Further, non-LED surface 455 may be configured so as not to subtend light emitted by LED 430. Nevertheless, a person of ordinary skill in the art will appreciate that crowns 477 may be configured with any number of shapes, curvatures, and/or surface qualities.

First, second, and third regions 450, 460, 470 may be stacked with each region appearing in a particular order to optimize subtended and non-subtended light from LED 330, and/or to optimize subtended light emanating from outside lighting component 410. For example, as exemplified in FIG. 4B, first region 450 may extend from PCBA 420, second region 460 may extend from first region 450 oppositely of PCBA 420, and third region 470 may extend from second region 460 oppositely of first region 450. In another example, each of the first, second, and third regions 450, 460, 470 may be dimensioned so that surfaces of each region align with surfaces of adjoining regions (e.g., left LED surface 443 and left non-LED surface 451 may align along a common line).

Each region of reflector 440 may be formed integrally to simplify manufacture and assembly and/or each region may be formed separately to accommodate other design considerations. For example, first second and third regions 450, 460, 470 may be formed integrally. In another example, first and second regions 450, 460 may be formed integrally, and third region 470 may be formed separately and may be interconnected with the first and second regions 450, 460 during assembly of lighting component 410. This configuration may be preferred where, for example, it is desirable to enable third region 470 to be customized to suit the preferences of a user of lighting component 410.

When LED 430 is supplied with electrical power, electrical power may be converted by LED 430 into visible and/or non-visible light. The light may be emitted from LED 430 and may pass through reflector 440. For example, all or substantially all the light emitted by LED 430 may be passed through central cavity 468. In another example, an effective span 432 of light emitted by LED 430 may pass entirely into central cavity 468. Effective span 432 may include an axis of symmetry 437 which may extend perpendicularly to a surface 421 of PCBA 420, may extend collinearly or parallel to central axis 467, and/or may extend at an incline with respect to central axis 467. In another example, light emitted by LED 430 may pass through central cavity 468, transparent media 403, or both.

Discrete portions of effective span 432 may be subtended (e.g., by left and right LED surfaces 443, 444) and/or discrete portions of effective span 432 may pass through reflector 440 without being subtended. For example, a left portion 474 of effective span 432 may be subtended (e.g., reflected) by left LED surface 443 to produce left subtended span 484. In another example, a right portion 475 of effective span 432 may be subtended (e.g., reflected) by right LED surface 444 to produce right subtended span 485. In another example, a third portion 476 of effective span 432 may pass through reflector 440 without being subtended by left and right LED surfaces 443, 444.

Left and right subtended spans 484, 485 may be any one or more of collimated, focused, diffused, and/or shifted light. Further, left and right subtended spans 484, 485 may be wider, equal to, or narrower than a span of third portion 476. Further, left and right subtended spans 484, 485 may pass entirely within the span of third portion 476. Further, left and right subtended spans 484, 485 may be symmetric or non-symmetric about central axis 467. Third portion 476 may not be any of collimated, focused, diffused, and/or shifted light.

The span of third portion 476 may be at least in part determined by a dimension of first region 450 in a depth-wise direction 469 and/or by the spacing between central axis 467 and opposing left and right LED surfaces 443, 444, or any combination thereof. Thus, the dimension of first region 450 in depth-wise direction 469 and/or the spacing between central axis 467 and one or more of opposing left and right LED surfaces 443, 444 may be altered in order to optimize the span of third portion 476. For example, third portion 476 may have a span of between about 20 degrees and about 150 degrees (e.g., about 80 degrees). Third portion 476 may be emitted symmetrically and/or non-symmetrically on either side of axis of symmetry 437.

One or more light rays originating from outside the system (e.g., light rays 486-489) may contact one or more of left and right non-LED surfaces 451, 452, non-LED surface 455, or other surfaces of the system (e.g., bottom and top non-LED surfaces 353, 354 of FIG. 3), and may be reflected away from reflector 440. For example, light rays 487, 488 are exemplified as reflecting from one or both of left and right non-LED surfaces 451, 452 before passing back through forward opening 462. In another example, light ray 489 is exemplified as reflecting from non-LED surface 455 before passing back through forward opening 462. Thus, reflector 440 may have a reflective quality whether or not LED 430 receives electrical power.

FIGS. 5A-5E illustrate lighting components having various numbers of quadrants. For example, a single quadrant may be represented by a single set of first, second, and third regions and their respective LED and non-LED surfaces (e.g., reflector 240 of FIG. 2 may exemplify a single quadrant). In another example, a quadrant may be represented by any portion of a reflector which independently subtends light from a dedicated LED.

Figure 5A:
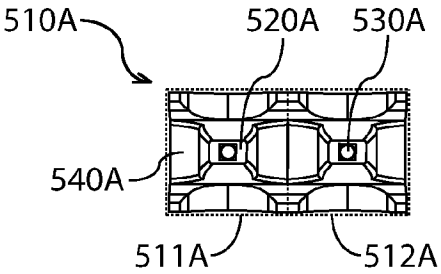
FIG. 5A illustrates a front view of a lighting component according to another embodiment of the present invention.

FIG. 5A illustrates a lighting component 510A including a PCBA 520A, a reflector 540A configured on PCBA 520A, and two LEDs 530A configured on PCBA 520A to emit light through a first quadrant 511A and a second quadrant 512A, respectively, of lighting component 510A (e.g., corresponding to repeating segments of reflector 540A). The repeating segments of reflector 540A may be configured in a side-by-side series (e.g., with one row and two columns) such that lighting component 510A may have a height (e.g., height 263 of FIG. 2) and a width (e.g., two times width 264 of FIG. 2).

Figure 5B:
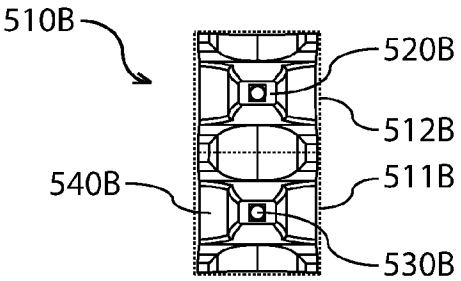
FIG. 5B illustrates a front view of a lighting component according to another embodiment of the present invention.

FIG. 5B illustrates a lighting component 510B including a PCBA 520B, a reflector 540B configured on PCBA 520B, and two LEDs 530B configured on PCBA 520B to emit light through a first quadrant 511B and a second quadrant 512B, respectively, of lighting component 510B (e.g., corresponding to repeating segments of reflector 540B). The repeating segments of reflector 540B may be configured in a top-to-bottom series (e.g., with two rows and one column) such that lighting component 510B may have a height (e.g., two times height 263 of FIG. 2) and a width (e.g., width 264 of FIG. 2).

Figure 5C:
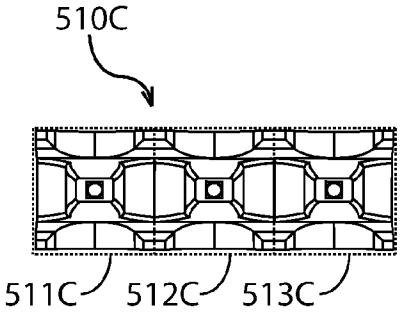
FIG. 5C illustrates a front view of a lighting component according to another embodiment of the present invention.

FIG. 5C illustrates a lighting component 510C including a first quadrant 511C, a second quadrant 512C, and a third quadrant 513C in a side-by-side series (e.g., with one row and three columns) and having a height (e.g., height 263 of FIG. 2) and a width (e.g., three times width 264 of FIG. 2).

Figure 5D:
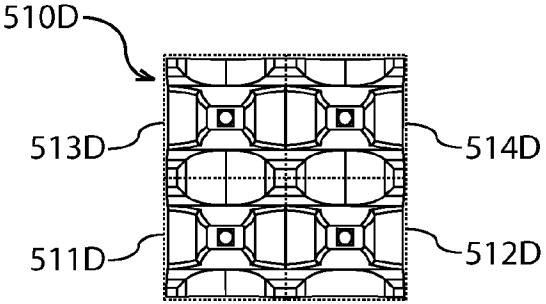
FIG. 5D illustrates a front view of a lighting component according to another embodiment of the present invention.

FIG. 5D illustrates a lighting component 510D including a first quadrant 511D, a second quadrant 512D, a third quadrant 513D, and fourth quadrant 514D. The quadrants of lighting component 510D are configured in an array (e.g., a 2×2 array with two rows and two columns) such that lighting component 510D may have a height (e.g., two times height 263 of FIG. 2) and a width (e.g., two times width 264 of FIG. 2).

Figure 5E:
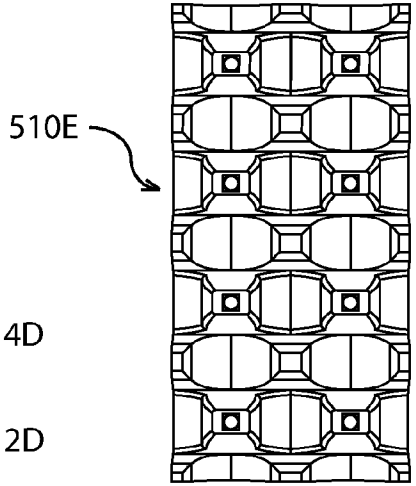
FIG. 5E illustrates a front view of a lighting component according to another embodiment of the present invention.

FIG. 5E illustrates a lighting component 510E including eight quadrants configured in an array (e.g., a 4×2 array, including four rows and two columns). Lighting component 510E may have a height (e.g., four times height 263 of FIG. 2) and a width (e.g., two times width 264 of FIG. 2). Lighting component 510E may be configured in a light fixture (e.g., light fixtures 100, 105 of FIG. 1). While FIGS. 5A-5E exemplify lighting components of a particular size and/or having a particular number of quadrants, a person of ordinary skill in the art will appreciate that a lighting component may be configured with greater or fewer numbers of quadrants than those illustrated, and in series and array configurations different than those illustrated.

While the embodiments of FIGS. 5D and 5E illustrate lighting components with rows and columns that appear aligned in a grid configuration, it may be possible to offset adjacent rows of quadrants in a width-wise direction (e.g., corresponding to width 264 of FIG. 2) to offset adjacent columns of quadrants in a height-wise direction (e.g., corresponding to height 263 of FIG. 2), and/or to offset each quadrant from one or more adjacent quadrants in a depth-wise direction (e.g., corresponding to depth 369 of FIG. 3). Furthermore, each quadrant may be rotationally offset from one or more other quadrants.

Figure 6:
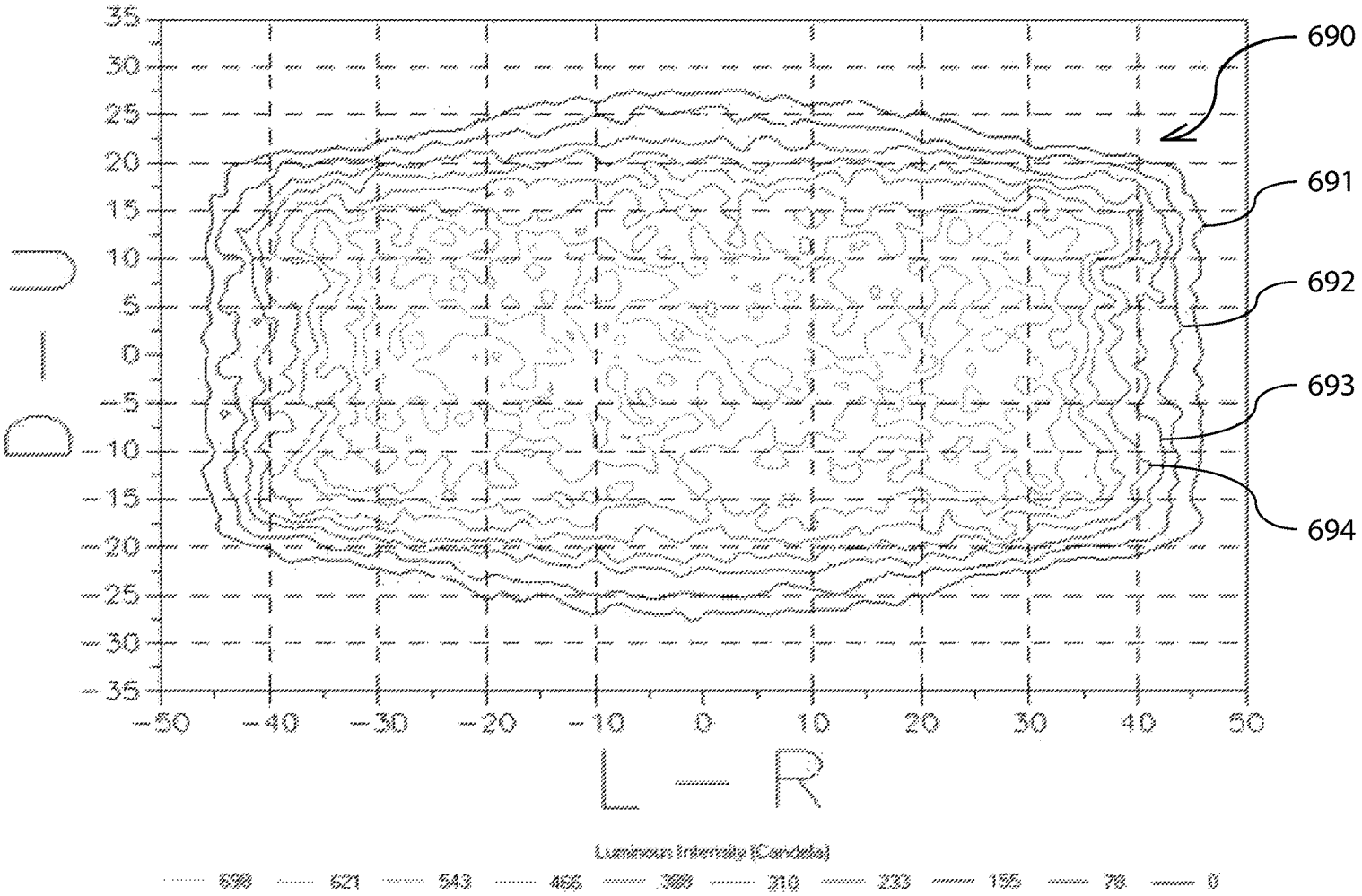
FIG. 6 illustrates an isocandella diagram of a target luminance of light emitted by the lighting component of FIG. 2.

FIG. 6 illustrates an isocandela diagram of a target luminance (e.g., beam pattern 690) of light emitted by a lighting component (e.g., lighting component 510D of FIG. 5D). In general, isocandela plots illustrate the luminous intensity of a light source, or, as in this case, the luminous intensity of beam pattern 690. As exemplified in the isocandela diagram of FIG. 6, beam pattern 690 may extend along a width-wise axis (e.g., L-R axis) and along a height-wise axis (e.g., D-U axis), such that the target luminance of emitted light passes through the plane formed by these axes. Furthermore, the incremental values extending along each axis may approximately represent angles from an axis of symmetry (e.g., axis of symmetry 437 of FIG. 4B) of the light emitting LED (e.g., LED 430 of FIG. 4), or in this case, angles from a chief axis extending approximately centrally between one or more axes of symmetry of one or more LEDs. For example, the chief axis may pass through the plane formed by the L-R & D-U axes at the zero values along these axes (e.g., 0,0). In another example, the chief axis may be perpendicular and/or inclined with respect to the plane formed by the L-R & D-U axes.

The target luminance may by described in terms of a series of loops (e.g., bands 691-694, or more) which indicate an intensity of beam pattern 690 along each respective loop. For example, a first band 691 may represent a first luminous intensity (e.g., about 78 candela), and may represent a boundary between luminous intensities below and above the first luminous intensity. In this example, points along the L-R and D-U axes and outside band 691 may be less than the first luminous intensity, and points along the L-R and D-U axes and inside band 691 may be greater than the first luminous intensity.

In another example, a second band 692 may represent a second luminous intensity (e.g., about 155 candela). In this example, points along the L-R and D-U axes and outside band 692 may be less than the second luminous intensity, and points along the L-R and D-U axes and inside band 692 may be greater than the second luminous intensity. For example, band 692 may lie interior to and/or may be entirely enclosed by band 691 (e.g., such that band 692 represents a higher luminous intensity than band 691). One or more additional bands may lie interior to band 692 (e.g., bands 693, 694, or more), and each subsequently interior band may represent an incrementally higher luminous intensity (e.g., 233, 310, or more candela). For example, seven or more bands may lie interior to band 692, each having incrementally higher luminous intensity. Nevertheless, a person of ordinary skill in the art will appreciate that any number of bands may be possible to represent luminous intensity of beam pattern 690.

The proximity of each band to adjacent bands may be indicative of a slow or a quick transition between luminous intensity values. For example, bands that are relatively close together may indicate a quick transition of luminous intensity (e.g., high to low, low to high). In another example, bands that are relatively far apart may indicate a slow transition of luminous intensity. Beam pattern 690 may include one or more bands of relatively close proximity and/or one or more bands of relatively distant proximity. For example, an outer perimeter of beam pattern 690 may be characterized by one or more relatively close, coextending bands (e.g., 6 most exterior bands as exemplified in FIG. 6), such that beam pattern 690 may have a quick transition from low luminous intensity to high luminous intensity. In another example, a core of beam pattern 690 may be characterized by one or more relatively distant and/or divergent bands (e.g., 4 most interior bands as exemplified in FIG. 6). Thus, beam pattern 690 may be characterized by a steep increase in luminous intensity around the perimeter, and a divergence of luminous intensity in the core.

A width-wise extent of beam pattern 690 may correspond to a span of subtended light (e.g., left and right portions 474, 475) and/or non-subtended light (e.g., third portion 476). For example, the width-wise extent of beam pattern 690 may be between about 20 degrees and about 150 degrees (e.g., about 80 degrees). In another example, the width-wise extent of beam pattern 690 may span from about −40 degrees to about 40 degrees along the L-R axis.

A height-wise extent of beam pattern 690 may correspond to a span of subtended light (e.g., bottom and top portions 371, 372) and/or non-subtended light (e.g., third portion 373). For example, the height-wise extent of beam pattern 690 may be between about 5 degrees and about 120 degrees (e.g., about 40 degrees). In another example, the height-wise extent of beam pattern 690 may span from about −20 degrees to about 20 degrees along the D-U axis.

A person of ordinary skill in the art will appreciate that the lighting component producing beam pattern 690 may be modified to widen and/or narrow the width-wise and height-wise extents of beam pattern 690. For example, dimensions, foci, and/or spacing of reflective surfaces (e.g., reflective surfaces 241, 251 of FIG. 2) may be configured to increase and/or decrease the size of a beam pattern as compared to beam pattern 690. In another example, beam pattern 690 may be symmetric and/or non-symmetric across the L-R and D-U axes.

Furthermore, while beam pattern 690 may be the result of a particular lighting component with a specified number of quadrants (e.g., a 2×2 lighting component with two rows and two columns), a person of ordinary skill in the art will appreciate that lighting components with greater or fewer quadrants may produce a similarly shaped beam pattern with higher or lower luminous intensity values at each corresponding band and/or a greater or fewer number of bands corresponding to luminous intensities exemplified in FIG. 6.

Thus, in accordance with the above principles, a target luminance (e.g., beam pattern 690) may be achieved which is substantially rectangularly shaped in the plane formed by the L-R and D-U axes, and which has a desired luminous intensity. For example, the ratio of the width-wise to height-wise extents of beam pattern 690 may be between about 5:1 and about 1:5 (e.g., about 2:1). Thus, beam pattern 690, as exemplified in FIG. 6, may be particularly suited to applications requiring a relatively consistent luminous intensity across a specified width and height (e.g., corresponding to the width-wise and height-wise extend of beam pattern 690). Furthermore, the size of beam pattern 690 may be optimized to suit the sizing needs of a particular application.

Other aspects and embodiments of the present invention will be apparent to those skilled in the art from consideration of the specification and practice of the invention disclosed herein. It is intended, therefore, that the specification and illustrated embodiments be considered as examples only, with a true scope and spirit of the invention being indicated by the following claims.

What is claimed is:

1. A reflector, comprising:

a first region formed by top, right, bottom and left surfaces forming a rearward opening, each of the surfaces extending from the rearward opening toward a forward opening each of the surfaces configured to subtend light emitted from a light source configured proximate the rearward opening; and a second region formed by the top and bottom surfaces, the top and bottom surfaces extending toward the forward opening, the second region further formed by right and left surfaces extending from the right and left surfaces of the first region toward the forward opening, the right and left surfaces of the second region configured so that no light emitted by the light source is subtended by the right and left surfaces of the second region.

2. The reflector of claim 1, wherein the top and bottom surfaces are formed by a parabolic trough extending in a width-wise dimension of the reflector, and wherein the right and left surfaces of the first region are formed by a parabolic trough extending in a height-wise dimension of the reflector.

3. The reflector of claim 2, wherein the top and bottom surfaces have a first focus and the right and left surfaces of the first region have a second focus different than the first focus.

4. The reflector of claim 2, wherein the right and left surfaces of the second region are further configured to subtend exterior light entering the reflector through the forward opening and direct the exterior light back out the forward opening.

5. The reflector of claim 1, further including a third region extending from the second region to the forward opening, the third region formed by one or more surfaces configured so that no light emitted by the light source is subtended by the one or more surfaces of the third region.

6. The reflector of claim 5, wherein the top and bottom surfaces, the right and left surfaces of the first region, the right and left surfaces of the second region, and the one or more surfaces of the third region are reflective.

7. A lighting component, comprising:

a PCEA;

an LED coupled to the PCBA, the LED configured to emit an effective span of light; and a reflector coupled to the PCBA in proximity to the LED so that the effective span of light passes through the reflector from a rearward opening of the reflector toward a forward opening of the reflector, the reflector including:

a first region formed by top, right, bottom and left surfaces forming the rearward opening, each of the surfaces extending from the rearward opening toward the forward opening, the top and bottom surfaces configured to subtend a first portion of the effective span of light, the right and left surfaces configured to subtend a second portion of the effective span of light; and a second region formed by the top and bottom surfaces, the top and bottom surfaces extending toward the forward opening, the second region further formed by right and left surfaces extending from the night and left surfaces of the first region toward the forward opening, the right and left surfaces of the second region configured so that no portion of the effective span of light is subtended by the right and left surfaces of the second region.

8. The lighting component of claim 7, wherein the reflector further includes a third region extending from the second region to the forward opening, the third region formed by one or more surfaces configured so that no portion of the effective span of light is subtended by the one or more surfaces of the third region.

9. The lighting component of claim 8, wherein a third portion of the effective span of light passes from the rearward opening of the reflector to the forward opening of the reflector without being subtended by the top and bottom surfaces, the right and left surfaces of the first region, the right and left surfaces of the second region or the one or more surfaces of the third region.

10. The lighting component of claim 9, wherein a first span of the third portion of the effective span is determined by one or more of a depth-wise dimension of the first region and a first spacing between the right and left surfaces of the first region in a width-wise dimension, and wherein a second span of the third portion of the effective span is determined by one or more of a depth-wise dimension of the first and second regions, collectively, and a second spacing between the top and bottom surfaces in a height-wise dimension.

11. The lighting component of claim 10, wherein the first span is between about 20 degrees and about 150 degrees, and wherein the second span is between about 5 degrees and about 120 degrees.

12. The lighting component of claim 10, wherein the first span is about 80 degrees, and wherein the second span is about 40 degrees.

13. The lighting component of claim 9, wherein the first and second portions fail within the span of the third portion of the effective span.

14. The lighting component of claim 7, wherein the first portion is substantially collimated light.

15. The lighting component of claim 7, wherein the second portion is substantially collimated light.

16. A light fixture, comprising:

a housing;

a PCBA coupled to the housings;

an LED coupled to the PCBA, the LED configured to emit an effective span of light;

a reflector coupled to the PCBA in proximity to the LED so that light from the LED passes through the reflector from a rearward opening of the reflector toward a forward opening of the reflector, the reflector including, a first region formed by top, right, bottom and left curved surfaces forming the rearward opening, each of the curved surfaces extending from the rearward opening toward the forward opening; and a second region formed by the top and bottom curved surfaces, the top and bottom curved surfaces extending toward the forward opening, the second region further formed by right and left flat surfaces extending from the right and left curved surfaces toward the forward opening, the right and left flat surfaces configured to subtend exterior light entering the forward opening; and a media extending over the housing to enclose the PCBA, the LED and the reflector.

17. The light fixture of claim 16, wherein the reflector is configured with one or more extension portions to ensure the reflector is an optimal separation distance from the LED, the PCBA, or both.

18. The light fixture of claim 16, wherein the reflector is configured with one or more mechanical indexing features and the PCBA is configured with one or more mechanical indexing features, and wherein mechanical indexing features of the reflector interconnect with the mechanical indexing features of the PCBA to ensure the reflector is in an optimal geometric configuration.

19. The light fixture of claim 16, wherein the reflector further includes a third region extending from the second region to the forward opening, the third region formed by one or more surfaces configured so that no light from the LED is subtended by the one or more surfaces of the third region.

20. The light fixture of claim 19, wherein the one or more surfaces of the third region form one or more crowns extending to the forward opening to couple with the media, and wherein the one or more crowns enable the reflector to be held between the PCBA and the media within the housing.

* * * * *